United States Patent [19]

Rossi

[11] 4,088,162

[45] May 9, 1978

[54] INFLATABLE SIGNAL DEVICE

[75] Inventor: Nicholas V. Rossi, 21 Greeley St., Sayville, N.Y. 11782

[73] Assignees: Nicholas V. Rossi, Sayville, N.Y.; Pasquale Sclafani; Orlando N. Rossi, both ofWatertown, Mass.; Victor H. Rossi, Medford, Mass.; Richard P. Rossi, Arlington, Mass.

[21] Appl. No.: 690,949

[22] Filed: May 28, 1976

[51] Int. Cl.[2] ..... B65B 39/00

[52] U.S. Cl. ..... 141/353; 116/124 B; 137/522

[58] Field of Search ..... 141/67, 348–362, 141/311, 313, 386, 38, 114, 223, 224; 116/124 B, DIG. 9; 137/522, 231; 251/12; 46/90

[56] References Cited

U.S. PATENT DOCUMENTS

| | | | |
|---|---|---|---|
| 3,174,519 | 3/1965 | Pizzurro et al. | 141/353 |
| 3,402,747 | 9/1968 | Tissot-Dupont | 141/352 |
| 3,527,250 | 9/1970 | Thomas et al. | 137/522 |
| 3,881,531 | 5/1975 | Rossi | 116/124 B |

*Primary Examiner*—Houston S. Bell, Jr.
*Attorney, Agent, or Firm*—Schiller & Pandiscio

[57] ABSTRACT

A signal device comprising a balloon, a balloon adaptor attachable to the balloon and having a hollow extension with a seat at one end thereof which end is extendable into the balloon, a sealing or valve member spring-biased on the seat of the balloon adaptor, and a supply adaptor. The supply adaptor includes a hollow stem which can be inserted into the hollow extension of the balloon adaptor so that the end of the stem lifts the sealing member from the seat against its spring-bias, so that ports formed in the hollow stem communicate with the interior of the balloon.

3 Claims, 7 Drawing Figures

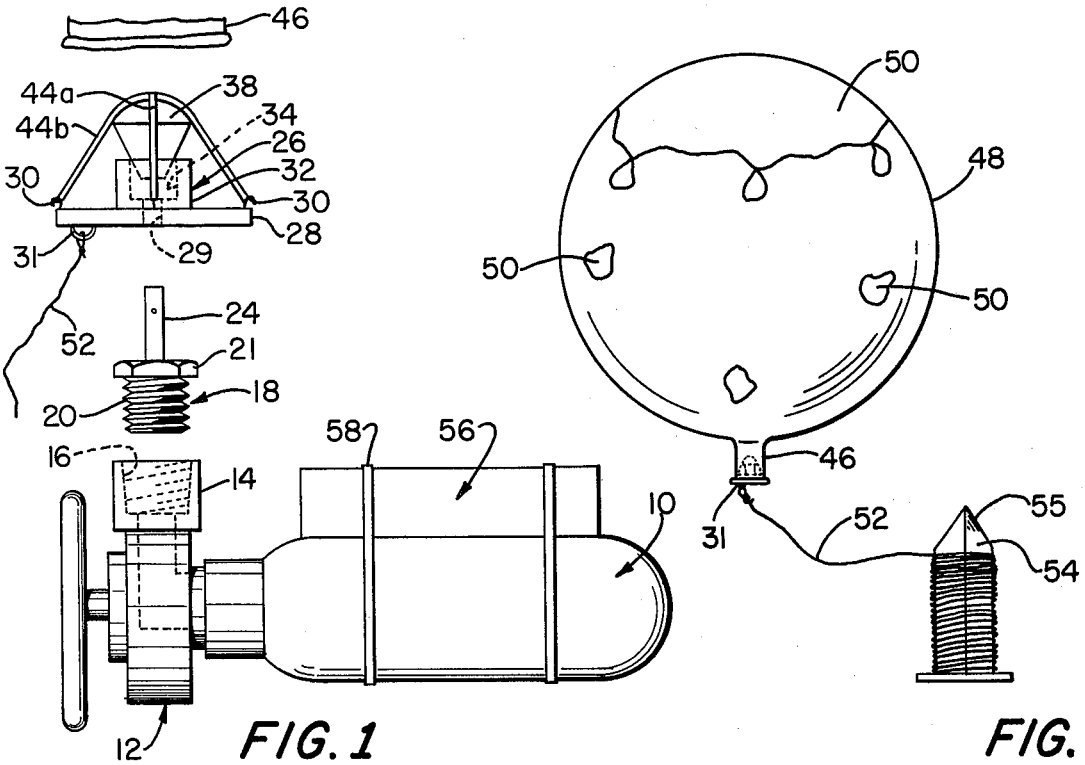
FIG. 1
FIG. 2
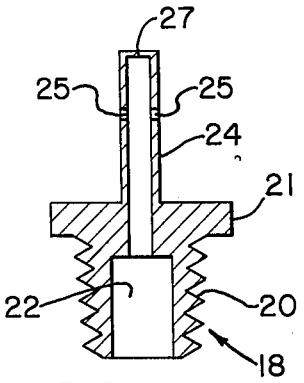
FIG. 3
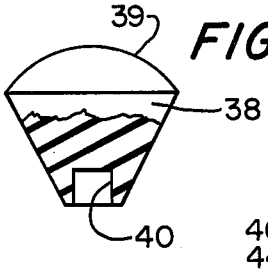
FIG. 4
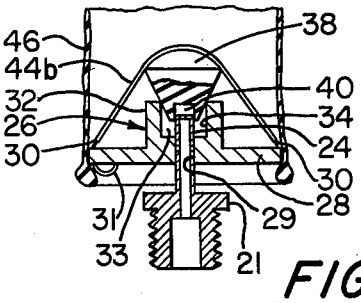
FIG. 5
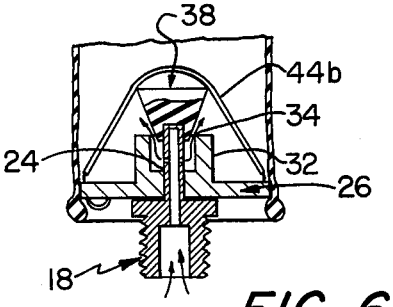
FIG. 6
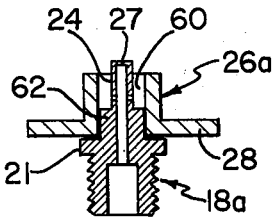
FIG. 7

INFLATABLE SIGNAL DEVICE

This invention relates generally to signal devices and more particularly to inflatable signal balloons.

Balloons are very often used as signaling devices to call attention, for example, to a person in distress. Typically, the balloon is stored in an uninflated condition until it is to be used. When used, it is filled with a gas that is lighter than air so that the balloon will rise and thereby increase its visibility.

One such signalling device is shown and described in my U.S. Pat. No. 3,881,531 issued May 6, 1975. That device includes a balloon which can be filled from a tank of gas. The device also includes a supply adaptor attached to the tank, and a balloon adaptor secured to the opening of the balloon and adapted to cooperate with the supply adaptor so that when the tank valve is opened, gas passes through the adaptors into the balloon. More specifically, the supply adaptor includes a hollow stem having one or more ports or escape openings. The balloon adaptor comprises a hollow extension having a seat at one end and an annular collar formed at its other end. A sealer or valve member, tapered to fit on and form an air tight seal with the seat of the hollow extension of the balloon adaptor is also provided. The valve member is biased in place in the seat by one or more resilient retainer members. In operation the hollow stem of the supply adaptor is inserted into the hollow extension of the balloon adaptor. The tank valve is opened and gas, under sufficient pressure to separate the valve member from the seat against the bias of the resilient member(s), flows through the ports into the hollow extension of the balloon adaptor where, because of its pressure, it forces the valve member away from the seat and inflates the balloon. Once inflated, the tank valve is closed and the biased valve member returns back in position onto the seat to seal the balloon. The stem is withdrawn from the extension and the balloon is ready for its ascent.

In accordance with the present invention, a signal device is provided which not only includes the advantages of my prior patented device but is modified so that (1) the balloon can be filled with a pressurized gas from the tank even though it is at a pressure which otherwise would be insufficient to separate the sealing member from the seat against the bias of the resilient members, and (2) the sealing member is substantially prevented from changing its orientation and becoming unseated from the seat of the hollow extension of the balloon adaptor during the gas filling operation, particularly when the incoming gas from the tank is at relatively large pressures.

It is therefore an object of the present invention to provide an improved signal device of the balloon type described in my U.S. Pat. No. 3,881,531.

Another object of the present invention is to provide an improved signal device of the inflatable balloon type in which the balloon can be safely filled with a "lighter than air" gas.

Yet another object of the present invention is to provide an inflatable balloon signal device in which the balloon can be reliably filled with a gas so long as the pressure of the gas is above atmospheric pressure.

These and other objects are achieved by a signal device of the type described in my U.S. Pat. No. 3,881,531 which is characterized by the fact that the supply adaptor (and in particular its hollow stem) is dimensioned so that when its hollow stem is inserted into the hollow extension of the balloon adaptor, the end of the stem cooperates with means in the sealing member to lift the sealing member from the seat of the hollow extension of the supply adaptor against the bias of the resilient member(s) so that the port(s) of the stem communicate with the interior of the balloon.

Other features and many of the attendant advantages of the invention are disclosed in or rendered obvious by the following detailed description which is to be considered together with the accompanying drawing in which:

FIG. 1 is an exploded view, partially fragmented, of the preferred embodiment of the present invention;

FIG. 2 is an elevational view showing a balloon inflated in accordance with the present invention ready for use;

FIG. 3 is an enlarged longitudinal sectional view of the supply adaptor of FIG. 1;

FIG. 4 is an enlarged elevational view, partially in section, of the sealer member of FIG. 1;

FIG. 5 is a fragmentary sectional view, on a reduced scale, showing the supply adaptor and balloon adaptor of FIG. 1 ready for use with the sealing member in a closed position;

FIG. 6 is a fragmentary sectional view, similar to FIG. 5 showing the sealing member in an opened position; and FIG. 7 is a cross-sectional view of a modified embodiment of the supply adaptor.

As illustrated, a tank or container 10 is adapted to hold a supply of gas such as helium, which preferably is lighter than air and is under a pressure greater than atmospheric pressure. Tank 10 is of a type well known in the art and includes a valve 12 having neck 14, the latter being provided with an internal, screw-threaded bore 16 adapted to receive a hollow supply adaptor 18 as described below.

Adaptor 18 comprises a hollow connector member 20 which has an internal bore 22 and is exteriorly-threaded at one end 20 so that it is adapted to be screwed into sealing engagement with the bore 16 of neck 14. The other end of connector 20 is provided with a hex-shaped flange 21 and a hollow stem 24 which extends axially from the flange and communicates with the bore 22. Stem 24 preferably has a cylindrical shape with a circular cross-section, although other cross-sectional shapes will work equally as well. Stem 24 includes ports or escape openings 25 formed in the sides of the stem adjacent the end 27 of the stem.

A second or balloon adaptor 26 has an outer flange or collar 28 having an opening 29 therethrough. The upper surface of collar 28 is provided with at least four hooks 30, circumferentially spaced around the flange. Hooks 30 are preferably equiangularly spaced around and adjacent the peripheral edge of the collar and preferably are curved as shown. A ring 31 is attached on the bottom of collar 28 and extends therebelow. Adaptor 26 is also provided with a hollow extension 32 extending beyond the upper surface of flange 28. Hollow extension 32 defines a chamber 33, the bottom of which communicate with opening 29 and the top of which forms a seat 34. Opening 29 and chamber 33 of the balloon adaptor 26 as well as the stem 24 of supply adaptor 18 are sized so that the stem can be inserted through opening 29 into chamber 33 to a position where (a) flange 21 contacts the lower surface of collar 28, the ports 25 communicate with the chamber 33 and (c) the end 27 of the stem extends beyond the seat 34 of hollow extension 32, as shown in FIG. 6.

A sealer or valve member 38 having a frusto-conical body and preferably made of a resilient and yieldable material such as rubber, is sized to fit on and form an air-tight seal with seat 34 of balloon adaptor 26. Sealer member 38 is provided with a curved surface 39 at its larger end and an opening 40 at its smaller end. Opening or slot 40 is of a cross-sectional shape and is sized so as to receive the end 27 of stem 24 of the supply adaptor in a snug-fitting relation.

Resilient means, preferably in the form of two resilient bands 44*a* and *b* (shown in FIG. 1) are provided for biasing member 38 onto seat 34 of balloon adaptor 26 to maintain the air-tight seal. Bands 44 and 44*a* are connected to diametrically opposite hooks 30 so that they extend over and contact the curved surface 39 of member 38 to urge the latter against the seat. For the best results and to help insure that member 38 does not slip from between the hollow extension 32 and the bands, bands 44*a* and *b* are oriented at right angles to one another.

The balloon adaptor is secured in the neck 46 of an inflatable, preferably resilient, balloon 48 in an air-tight manner, by stretching the neck 46 around the collar 28 of the balloon adaptor, so that hollow extension 32 and member 38 extend into the interior of the balloon. The air-tight seal provided by the resiliency of the neck 46 against the collar 28 can be further enhanced by providing a suitable adhesive between the neck and collar. The balloon 48 is of a type well known in the art and is preferably covered with foil or a radar bonnet 50, in order to reflect radar signals. A string 52, provided on a spool 54 or similar device for winding the string, is attached to the ring 31 on the adaptor 26 by tieing or other means. The spool 54 is preferably tapered as at 55 at one end to facilitate the unwinding of the string after the balloon commences flight and tension is provided on the string. A casing 56 for housing the spool and string can be attached with bands 58 to the tank 10 so that the entire unit is portable wherein the string is conveniently available for attachment to the balloon adaptor.

When it is desirable to utilize the present invention, such as when a person is in distress, the supply adaptor 18 is secured in bore 16 of valve 12 and then positioned with the tank below the balloon adaptor 26 and balloon 48. The stem 24 of the supply adaptor 18 is then inserted through opening 29 into chamber 33 as shown in FIG. 5. Holding the neck 46 and balloon adaptor 26 in one hand, and the supply adaptor 18 in the other, the stem 24 is pushed relative to balloon adaptor 26 so that its end 27 extends into opening 40 of the member 38 against the bias of bands 44 and 44*a* until flange 21 of the supply adaptor contacts the lower surface of collar 28 as shown in FIG. 6. In this position the member 38 is forced off the seat 34 but prevented from slipping out from between seat 34 and bands 44 and 44*a* by virtue of the fact that the end 27 of stem 24 is inserted in opening 40 of valve 38 in an snug fitting relationship and is maintained in this relationship by the pressure exerted on the valve 38 by the bands 44 and 44*a* toward the stem.

Once the valve member 38 is lifted from seat 34, it is held in this position and the valve 12 is opened whereby air under pressure in tank 10 flows through adaptor 18 through the ports 25 into the chamber 33, and thence between the spaces between the valve member 38 and seat 34 into the balloon so that the latter inflates.

When the balloon is inflated the valve 12 is closed and stem 24 is withdrawn from chamber 33. As the stem is withdrawn, valve 38 reseats itself on the seat 34 (it is urged by bands 44 and 44*a* to seal the interior of the filled balloon from the chamber 33 and the opening 29 so that the gas in the balloon will not escape).

It will be appreciated that as the balloon is being filled flange 21 and stem 24 form a sufficient seal with the balloon adaptor so that most of the gas entering the chamber 33 will not escape from between the stem and balloon adaptor through the opening 29.

Various modifications may be made to the present invention without departing from the scope of the invention. For example, as shown in FIG. 7, supply adaptor 18A and balloon adaptor 26A are identical to adaptors 18 and 26, respectively, except that opening 29 and chamber 33 are formed with the same internal diameter to provide a bore 60. In order to maintain a tight fitting relationship between the adaptors when the balloon is being filled, supply adaptor 18A is modified to include an annular extension 62 with an outer cross-section diameter sized so that it slidably fits in bore 60 of adaptor 26A, between collar 28 and stem 24. Thus, when adaptor 18A is inserted into adaptor 26A, by inserting annular extension 62 into bore 60 so that end 27 of the stem contacts and raises the valve member 38 from the seat 34, incoming air from tank 10 will be directed wholly into balloon 48 by virtue of the snug fit between extension 62 of the adaptor 18A and bore 60 of adaptor 26A and engagement of flange 21 with collar 28.

Thus, several advantages are achieved with the present invention. Not only are the advantages of my prior patented device described in my U.S. Pat. No. 3,881,431 preserved, but the balloon can be filled with a gas at any pressure so long as the pressure is greater than atomospheric pressure. Even though the pressure might be insufficient to lift member 38 from the seat 34 against the bias of bands 44 and 44*a*, the member 38 is mechanically lifted from the seat by stem 24. The fact that the valve 38 is mechanically lifted and interlocked with stem 24 offers the further advantage that where the gas in the tank is under a relatively great pressure, the incoming gas will have less of a tendency to cause the valve to slip from or reorient itself with respect to the bands 44 and 44*a* and the hollow extension 32.

Since certain other changes may be made in the above-identified apparatus without departing from the scope of the invention herein involved, it is intended that all matter contained in the above-description or shown in the accompanying drawing shall be interpreted in an illustrative and not in a limiting sense.

What is claimed is:

1. In a signal device comprising (1) an inflatable balloon, (2) a balloon adaptor including a collar and a hollow extension attached to said collar and having a seat formed at one end thereof and an opening at a second end thereof, a valve member sized to fit on said seat, and bias means for urging said valve member against said seat in an air-tight relationship, and (3) a supply adaptor for directing a stream of gas into said balloon via said balloon adaptor, said supply adaptor including a flange and a hollow stem having at least one port on the side thereof, said hollow stem having an end section which is dimensioned so that it may be inserted into said hollow extension via said opening, said balloon adaptor being securable in the neck of said balloon so that said valve member and the said seat on said hollow extension extend into said balloon, the improvement comprising (1) a slot at one end of said valve member which is sized to receive said end section of said stem, (2) said hollow stem of said supply adaptor being long enough so that when said stem is inserted into the said hollow extension of said balloon adaptor via said opening, the end section of said stem may be disposed to engage said valve member so as to lift the valve member from said seat against the bias of said resilient means and thereby allow said port to communicate with the interior of said balloon, whereby gas will be able to flow from said supply adaptor into said balloon via said hollow extension, (3) said valve member being adapted to move clear of said seat while said end section of said stem is still received by said slot, whereby said bias means and said end section of said stem cooperate to prevent said valve member from reorienting itself with respect to said seat, and (4) said flange being disposed on said supply adaptor so as to limit further penetration of said stem into said hollow extension after said stem has lifted said valve member from said slot.

2. A signal device in accordance with claim 1, wherein said hollow extension defines a chamber, said opening and chamber being dimensioned so that said opening slidingly receives said stem and said port communicates with said chamber when said stem is inserted into said hollow extension and is disposed so as to lift said valve member clear of said seat.

3. A signal device in accordance with claim 1, wherein said balloon adaptor is provided with a bore defining the inner surface of said hollow extension, said supply adaptor includes an annular extension around said stem and said opening is sized to slidingly receive said annular extension, and further wherein said stem has a smaller diameter than said bore and said port of said stem communicates with said bore when said stem is inserted into said hollow extension in position to lift said valve member clear of said seat.

* * * * *